US006585250B1

(12) United States Patent
Hsiao

(10) Patent No.: US 6,585,250 B1
(45) Date of Patent: Jul. 1, 2003

(54) DOCUMENT SEPARATING APPARATUS

(75) Inventor: Sidney Hsiao, Zhang-Hua (TW)

(73) Assignee: Silitek Corporation, Taipei (TW)

( * ) Notice: Subject to any disclaimer, the term of this patent is extended or adjusted under 35 U.S.C. 154(b) by 161 days.

(21) Appl. No.: 09/711,084

(22) Filed: Nov. 14, 2000

(51) Int. Cl.[7] ..... B65H 3/52
(52) U.S. Cl. ..... 271/121; 271/126
(58) Field of Search ..... 271/306, 182, 271/121, 124, 126, 127

(56) References Cited

U.S. PATENT DOCUMENTS 4,575,068 A * 3/1986 Kato ..... 271/122
5,707,057 A * 1/1998 Oyama ..... 271/121
5,727,782 A * 3/1998 Okada ..... 271/121
5,764,384 A * 6/1998 Wilcox et al. ..... 271/10.11
6,010,126 A * 1/2000 Mou et al. ..... 271/121
6,017,031 A * 1/2000 Oosawa et al. ..... 271/10.09
6,151,140 A * 11/2000 Wilcox et al. ..... 271/121
6,290,224 B1 * 9/2001 Lin ..... 271/121

* cited by examiner

*Primary Examiner*—Patrick H. Mackey
(74) *Attorney, Agent, or Firm*—Rabin & Berdo, P.C.

(57) ABSTRACT

A document separating mechanism for an Automatic Document Feeder is an elastomer with the features of having a vertical plane and an arc surface, wherein the vertical plane is perpendicular to the main plane and capable of resisting the leading edges of the documents directly or indirectly. The arc surface is a turning plane for joining the vertical plane and the main plane. The document separating mechanism further includes the document guiding incline for making the documents being pressed by the feeding roller and arranged in order initially.

15 Claims, 7 Drawing Sheets

DOCUMENT SEPARATING APPARATUS

BACKGROUND OF THE INVENTION

This application incorporates by reference Taiwanese application Serial No. 89117960, Filed on Sep. 1st, 2000.

1. Field of the Invention

The invention relates in general to a document separating mechanism, and more particularly to a document separating mechanism for an automatic document feeder capable of being applied to the fax machine, scanner, or printer.

2. Description of the Related Art

Referring to FIG. 1, a lateral view of a traditional Automatic Document Feeder is shown. The feeding roller 102 carries the fed documents 100 to move forward. The fed documents 100 are sequentially pressed in between the feeding roller 102 and the rubber friction pad 106 with the elasticity of the spring unit 108 below the rubber friction pad 106. The input tray 110 for positioning the fed documents 100 has an inclined plane descending toward the feeding roller and friction pad.

While the fed documents 100 are placed on the input tray 110, the fed documents 100 are slid along the surface of the input tray 110 for positioning by the force of the gravity or the conveyance of the pick roller (not shown in FIGs). Generally speaking, the coefficient of friction for the feeding roller 102 and the fed documents 100 is greater than that between the fed documents 100 themselves and greater than that of the rubber friction pad 106 and the fed documents 100. The $\mu_1$, is assumed to be the coefficient of friction for the feeding roller 102 and the fed documents 100, the $\mu_2$ is assumed to be the coefficient of the fed documents 100 themselves, and the $\mu_3$ is assumed to be the coefficient of the rubber friction pad 106 and the fed documents 100, wherein $\mu_1>\mu_2>\mu_3$.

As the feeding roller 102 starts to rotate on its axis 104, the first document 100*a* moves forward by the frictional force between the feeding roller 102 and the first document 100*a*, since the coefficient of friction for the feeding roller 102 and the fed documents 100 $\mu_1$ is greater than that of the fed documents 100 themselves $\mu_2$. The first document 100*a* departs away from the other fed documents 100*b* and then comes into contact with the rubber friction pad 106. Since the coefficient of the fed documents 100 $\mu_1$ is greater than that of the rubber friction pad 106 and the fed documents 100 $\mu_3$, the first document 100*a* carried by the feeding roller 102 proceeds to move forward and is consequentially delivered. However, this caused the multiple feeding condition by utilizing the traditional Automatic Document Feeder due to the inadequate arrangement of the documents.

Referring to FIG. 2, a multiple feeding condition of the FIG. 1 arrangement is shown. When the fed documents are not sequentially arranged in order as shown in FIG. 1 and fail to be pressed by the feeding roller 102, the coefficient of friction of the documents 200*a* and the other fed documents 200*b* is smaller than that of the fed documents 200*b* themselves so that the documents 200*a* depart away together from the other fed documents 200*b*. Thus, the documents 200*a* are all pressed in between the feeding roller 102 and the rubber friction pad 106 with the elasticity of the spring unit 108 below the rubber friction pad 106. Thus, the documents 200*a* move forward and it comes into multiple feeding condition. Other conditions caused by the inadequate arrangement of the documents, such as the position of the backward document is ahead of the forward document or the inadequate thickness of the document—too thick or too thin, are likely to result in the multiple feeding condition or a jam condition.

SUMMARY OF THE INVENTION

It is therefore an object of the invention to provide a document separating mechanism for the Automatic Document Feeder, which can improve the multiple feeding condition caused by the variation of the documents and prevent the multiple feeding or jam condition as result of the inadequate arrangement of documents.

The invention achieves the above-identified objects by providing a document separating mechanism for an Automatic Document Feeder. The document separating mechanism is an elastomer with the features of having a vertical plane and an arc surface, wherein the vertical plane is perpendicular to the main plane and capable of resisting the leading edges of the documents directly or indirectly. The arc surface is a turning plane for joining the vertical plane and the main plane.

The invention achieves the above-identified objects by providing a document separating mechanism for an Automatic Document Feeder. The document separating mechanism is an elastomer with the features of having a vertical plane and an arc surface, wherein the document separating mechanism includes the first document guiding incline and the second document guiding incline which are linked to the main plane with the same slope respectively and capable of making the documents being pressed by the feeding roller and arranged in order initially.

The invention achieves the above-identified objects by further providing an Automatic Document Feeder. The Automatic Document Feeder includes an input tray, a document separating mechanism, a feeding roller, and a rubber friction pad, wherein the feeding roller for carrying the document to move forward. The rubber friction pad along with a spring unit below makes the document being pressed in between the feeding roller and the rubber friction pad with the elasticity of the spring unit. The input tray has an inclined plane descending toward for positioning the fed documents. The document separating mechanism is an elastomer for providing a resistance to restrain the second or the latter document from moving along.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
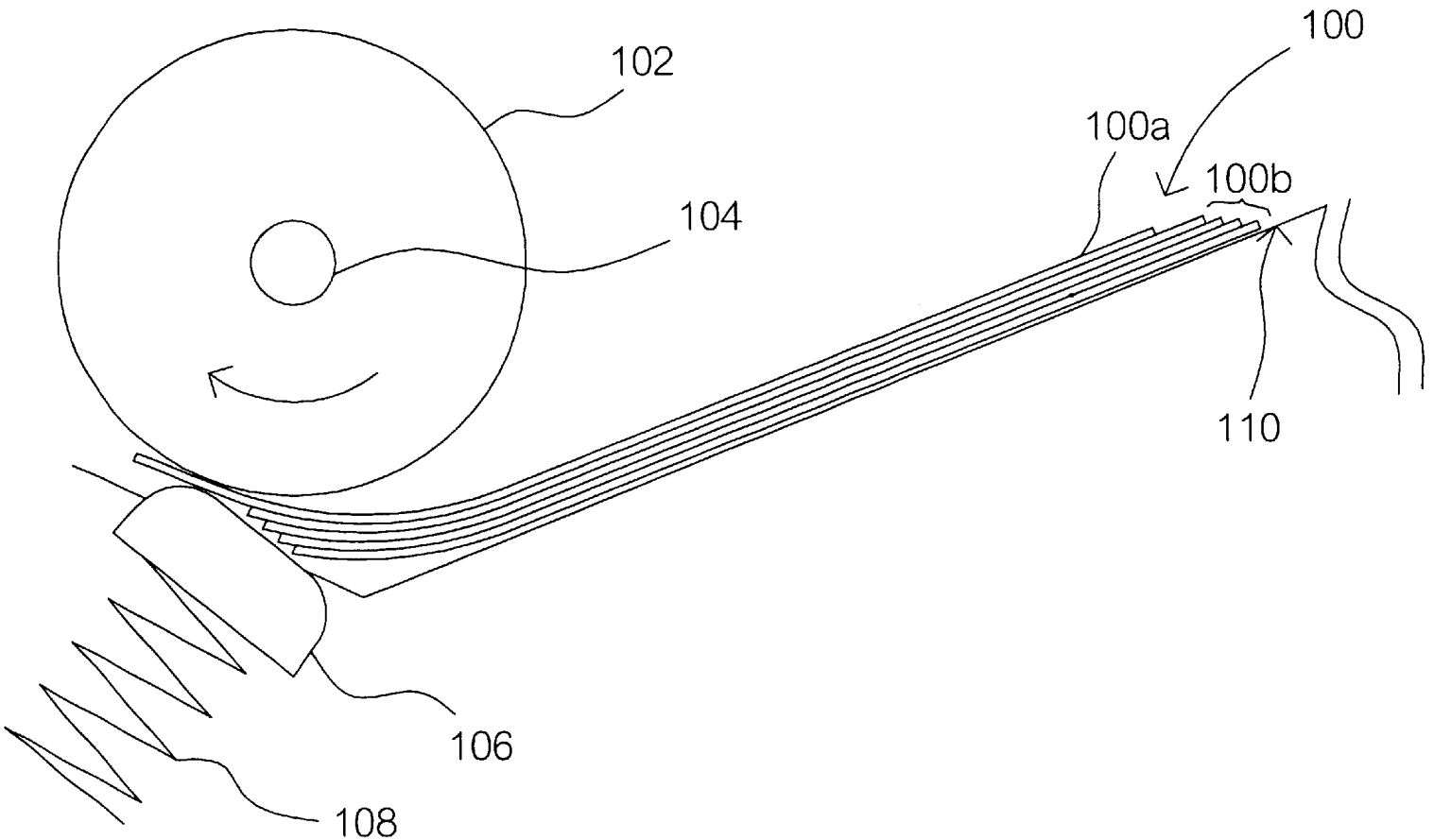
FIG. 1 (PRIOR ART)
FIG. 1 (Prior Art) shows a lateral view of a traditional Automatic Document Feeder.
Figure 2:
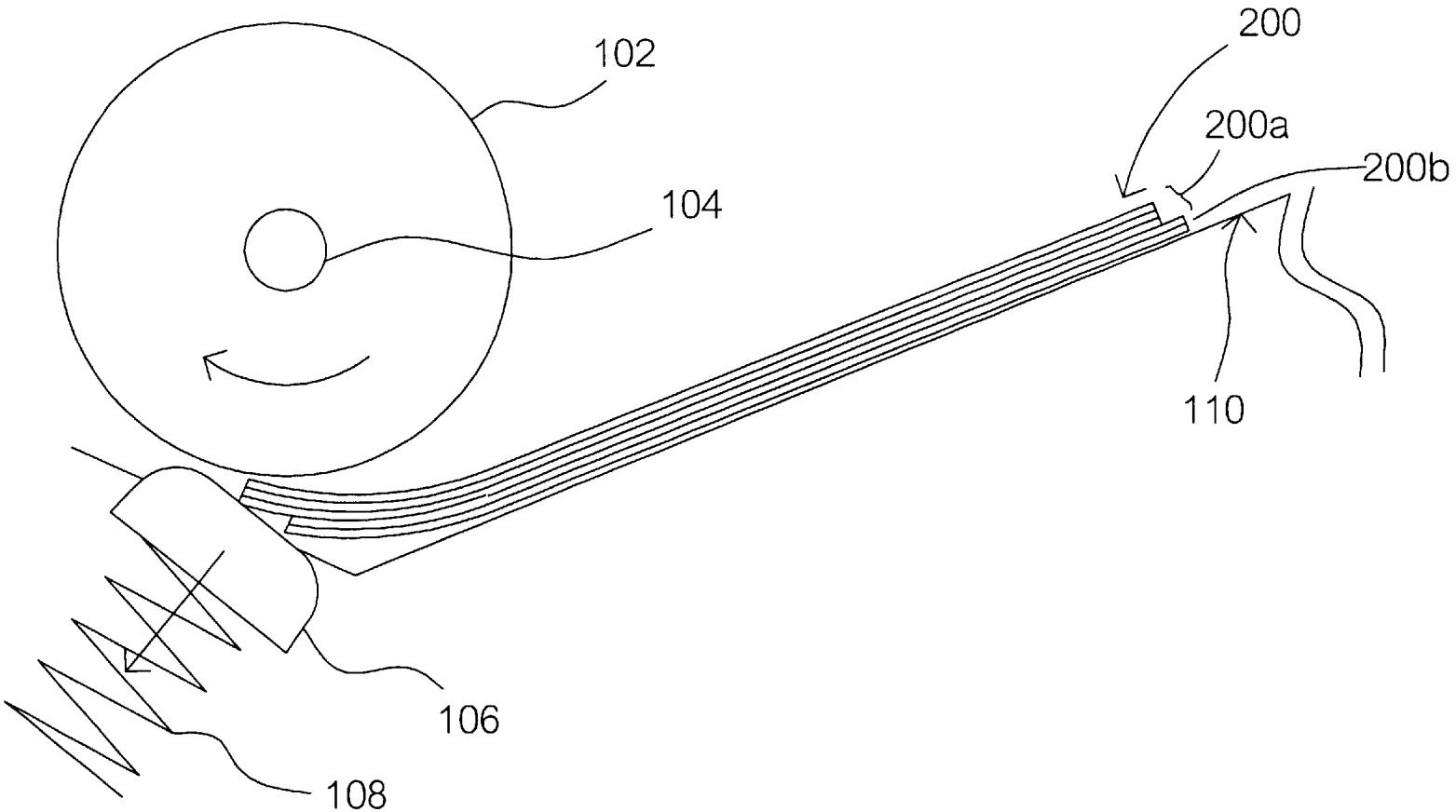
FIG. 2 (PRIOR ART)
FIG. 2 (Prior Art) shows a multiple feeding condition of the FIG. 1.
Figure 3:
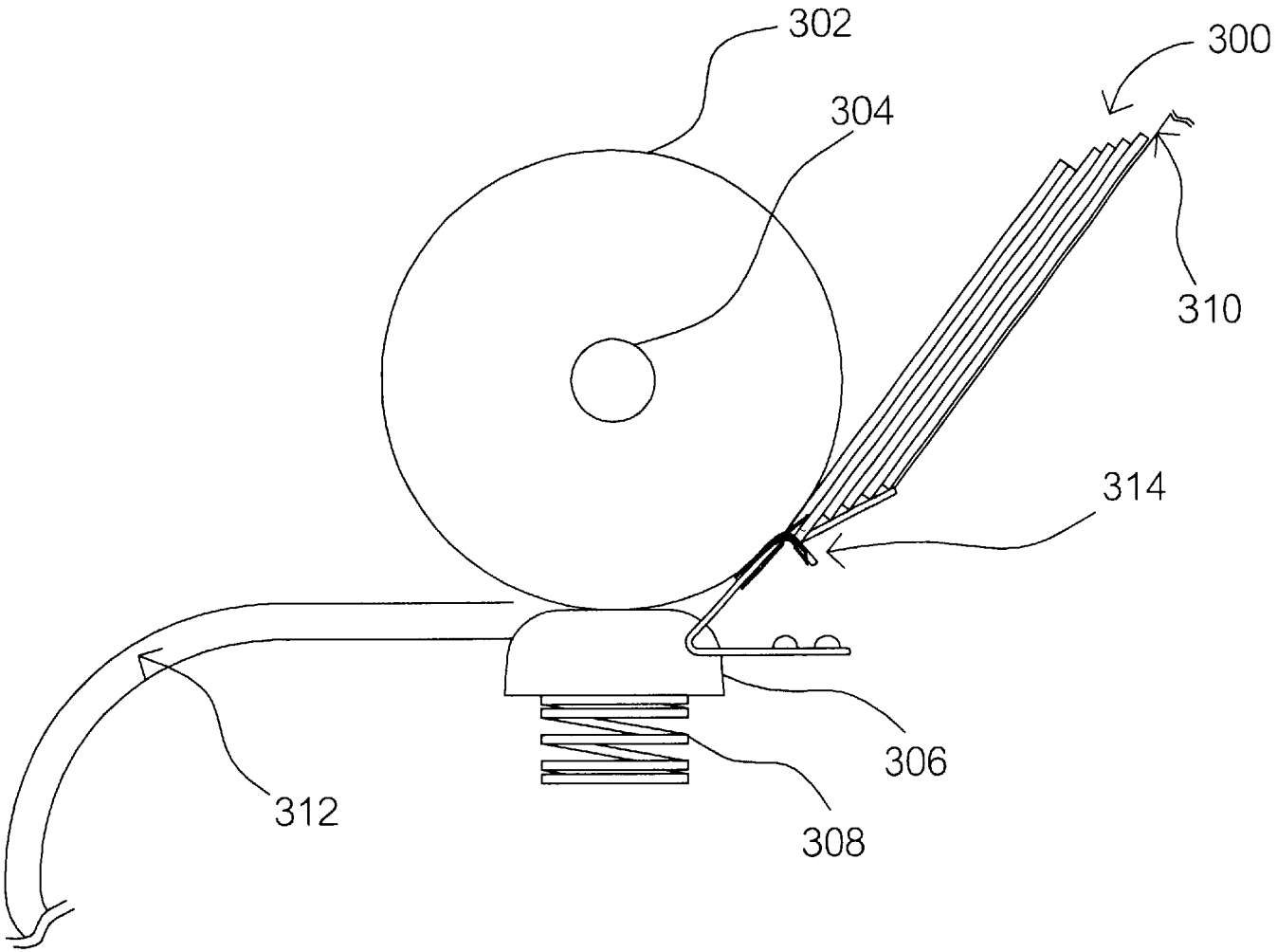
FIG. 3 shows a lateral view of an Automatic Document Feeder utilizing the document separating mechanism according to a preferred embodiment of the invention.

Referring to FIG. 3, a lateral view of an Automatic Document Feeder utilizing the document separating mechanism according to a preferred embodiment of the invention is shown. The Automatic Document Feeder includes a feeding roller 302, rubber friction pad 306, spring unit 308, input tray 310, document conveying path 312 *and document separating mechanism 314. The feeding roller 302 is connected with and driven by the motor (not shown in FIGs). Since the input tray 310 has an inclined plane descending toward the document separating mechanism 314, the fed documents 300 are slid along the surface of the input tray 310 by the force of the gravity or the conveyance of the pick roller (not shown in FIGs) until the leading edges of the fed documents 300 comes into contact with the document separating mechanism 314 for positioning. The document separating mechanism 314 is used for making the fed documents 300 sequentially being arranged in order and pressed by the feeding roller 302. Besides, it also provides a resistance to restrain the second or the latter document from moving along. The combination of the feeding roller 302, rubber friction pad 306, and spring unit 308 can drive the document to move forward. The document conveying path 312 guides the documents to the direction of transmission.

Figure 4:
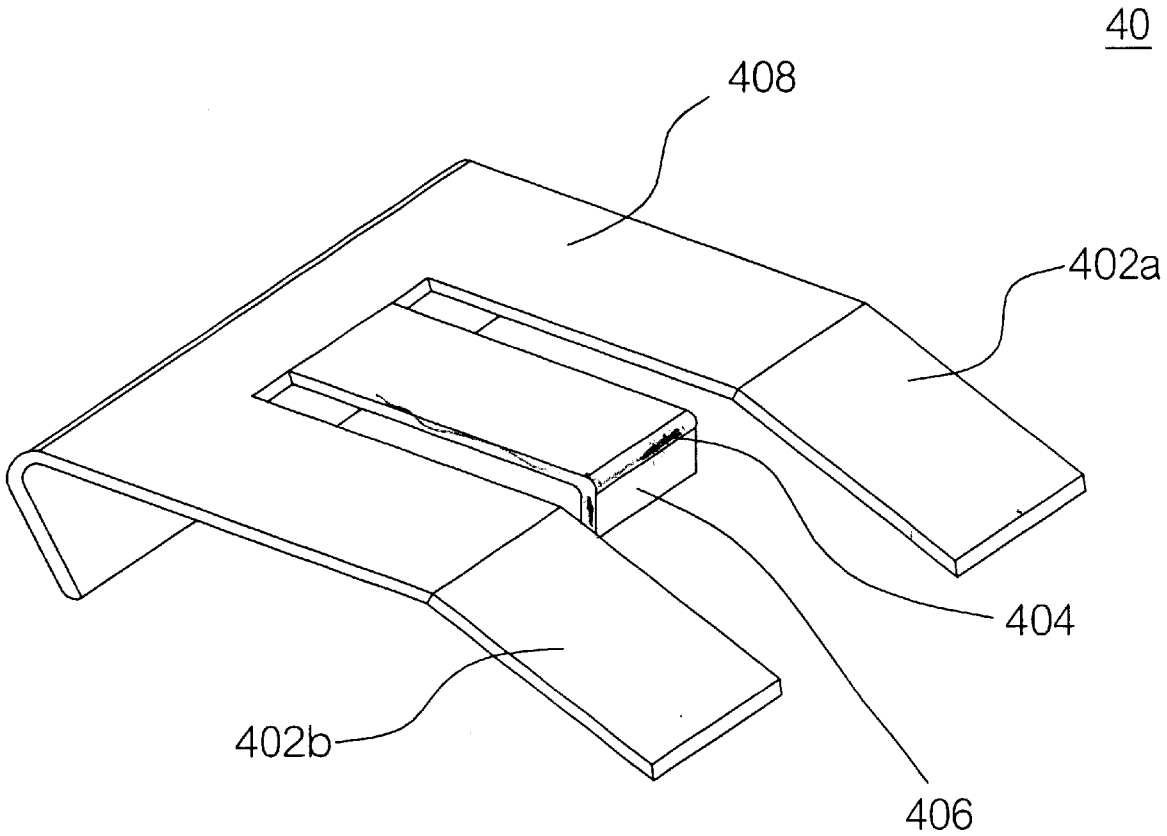
FIG. 4 shows a perspective structural diagram of a document separating mechanism according to a preferred embodiment of the invention.

Referring to FIG. 4, a perspective structural diagram of a document separating mechanism according to a preferred embodiment of the invention is shown. The document separating mechanism 40 is an elastomer with the feature of having an arc surface 404 and a vertical plane 406. The document separating mechanism 40 further includes the first document guiding incline 402*a*, second document guiding incline 402*b*, and main plane 408. The main plane 408 has several edges fringed with at least the arc surface 404, first document guiding incline 402*a*, and second document guiding incline 402*b*, wherein the first document guiding incline 402*a* and the second document guiding incline 402*b* are with the same slope. The arc surface 404 between the vertical plane 406 and the main plane 408 is a turning plane for joining the vertical plane 406 and the main plane 408, wherein the vertical plane 406 is perpendicular to the main plane 408.

Figure 5:
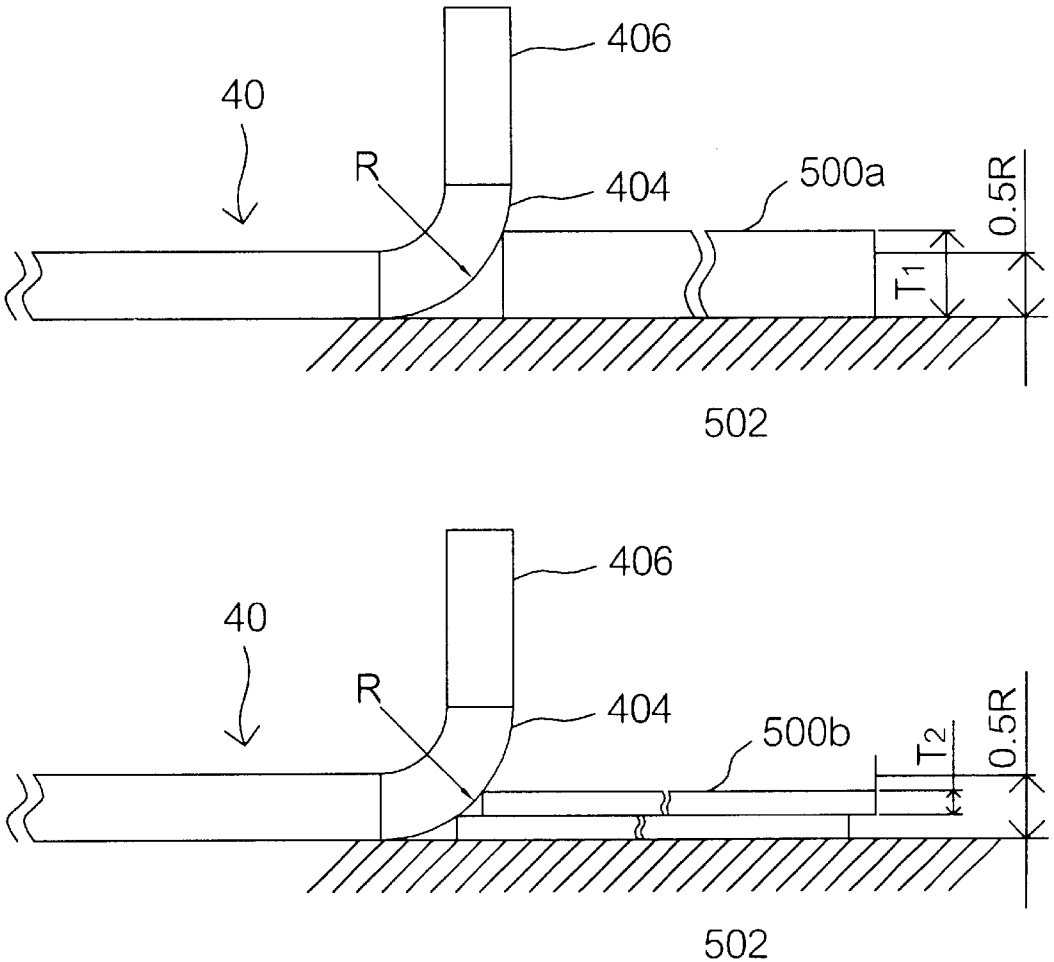
FIG. 5 illustrates the relation between the radius of arc surface and the thickness of the paper.

Referring to FIG. 5, the relation between the radius of arc surface and the thickness of the paper is illustrated. Assuming that the radius of curvature is R and the thickness of the document is T, the preferred range of the thickness of the document is between 0.25R and 0.5R (0.25R<T<0.5R). The practical design of the document separating mechanism depends on the size of the documents, the elasticity of the document separating mechanism and the propulsive force from the pick roller for adjustment. As shown in FIG. 5, in the case that the thickness of the document $T_1$ is greater than a half of the radius of curvature of the arc surface ($T_1$>0.5R), if neglecting the friction condition of the arc surface 404 and thick document 500*a*, the frictional force to the thick document 500*a* from the feeding roller 502 is smaller than the component in the parallel direction of the normal force to the thick document 500*a* from the arc surface 404. Thus, the thick document 500*a* fails to move forward as the feeding roller 502 rotates and it comes into jam condition. In the case that the two documents with a thickness less than 0.5R, that is to say, the thickness of the document $T_2$ is smaller than a quarter of the radius of curvature of the arc surface ($T_2$<0.25R) the frictional force to the second thin document from the first thin document thereunder is greater than the component in the parallel direction of the normal force to the first thin document from the arc surface 404. Thus, the two thin documents 500*b* both move forward as the feeding roller 502 rotates and it comes into double or multiple feeding condition.

Figure 6A:
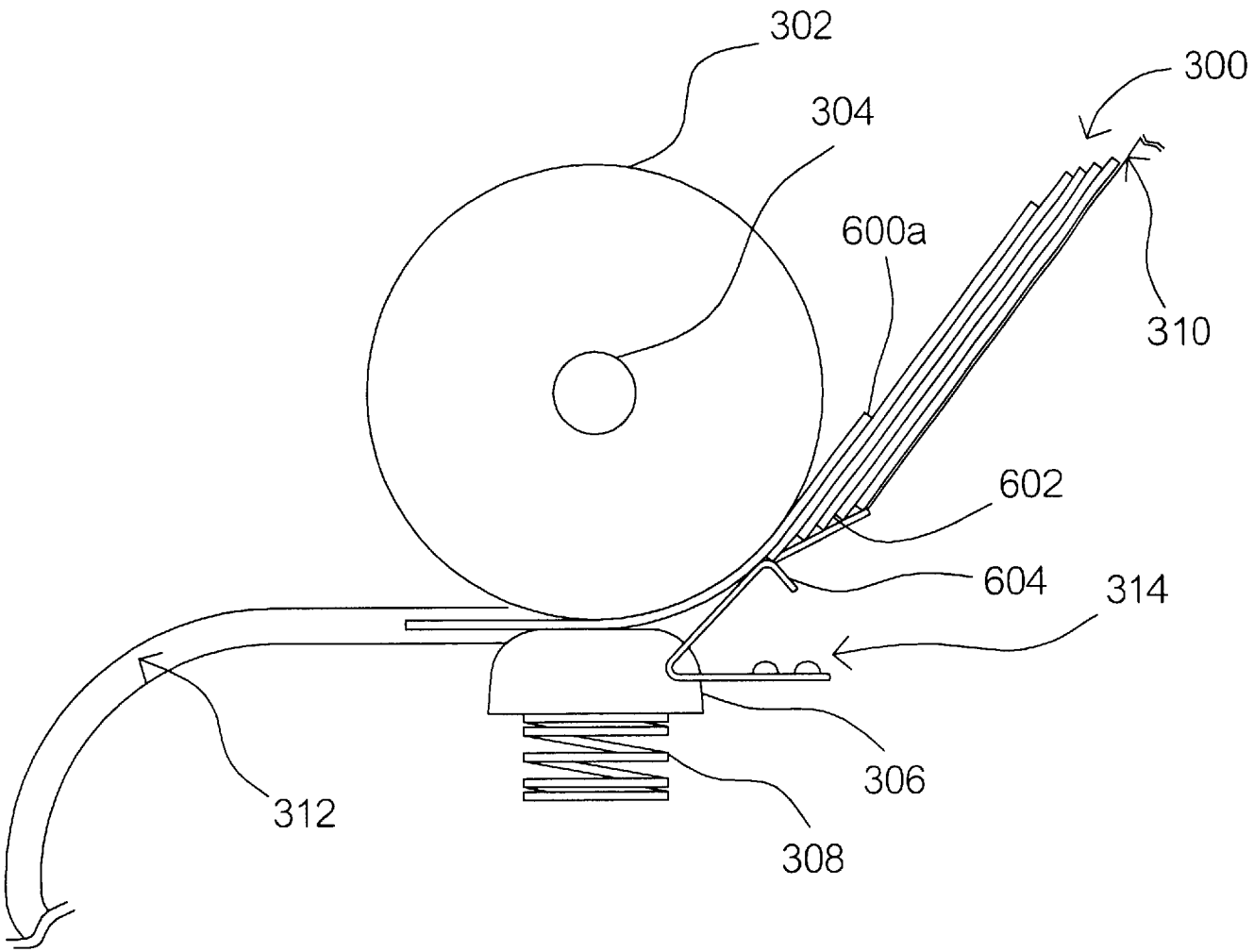
FIG. 6A shows the first phase of document feeding for the document separating mechanism in FIG. 3.

Referring to FIG. 6A, the first phase of document feeding for the document separating mechanism in FIG. 3 is shown. The document guiding incline 602 makes the documents being pressed by the feeding roller 302 and arranged in order initially. The feeding roller 302 starts to rotate on its axis 304, the thickness of the document is approximately smaller than a half and greater than a quarter of the radius of curvature of the arc surface 404 (0.25R<T<0.5R), the first document 600*a* carried by the feeding roller 302 pushes down the document separating mechanism 314 and proceeds to move forward by the frictional force between the first document 600*a* and the document separating mechanism 302. Meanwhile, the vertical plane 604 resists the leading edges of the second and the latter fed documents 300 from moving along and thus the documents are disposed on the document guiding incline 602 by the resistance from the vertical plane 604 directly or indirectly. Then the first document 600*a* is successfully delivered.

Figure 6B:
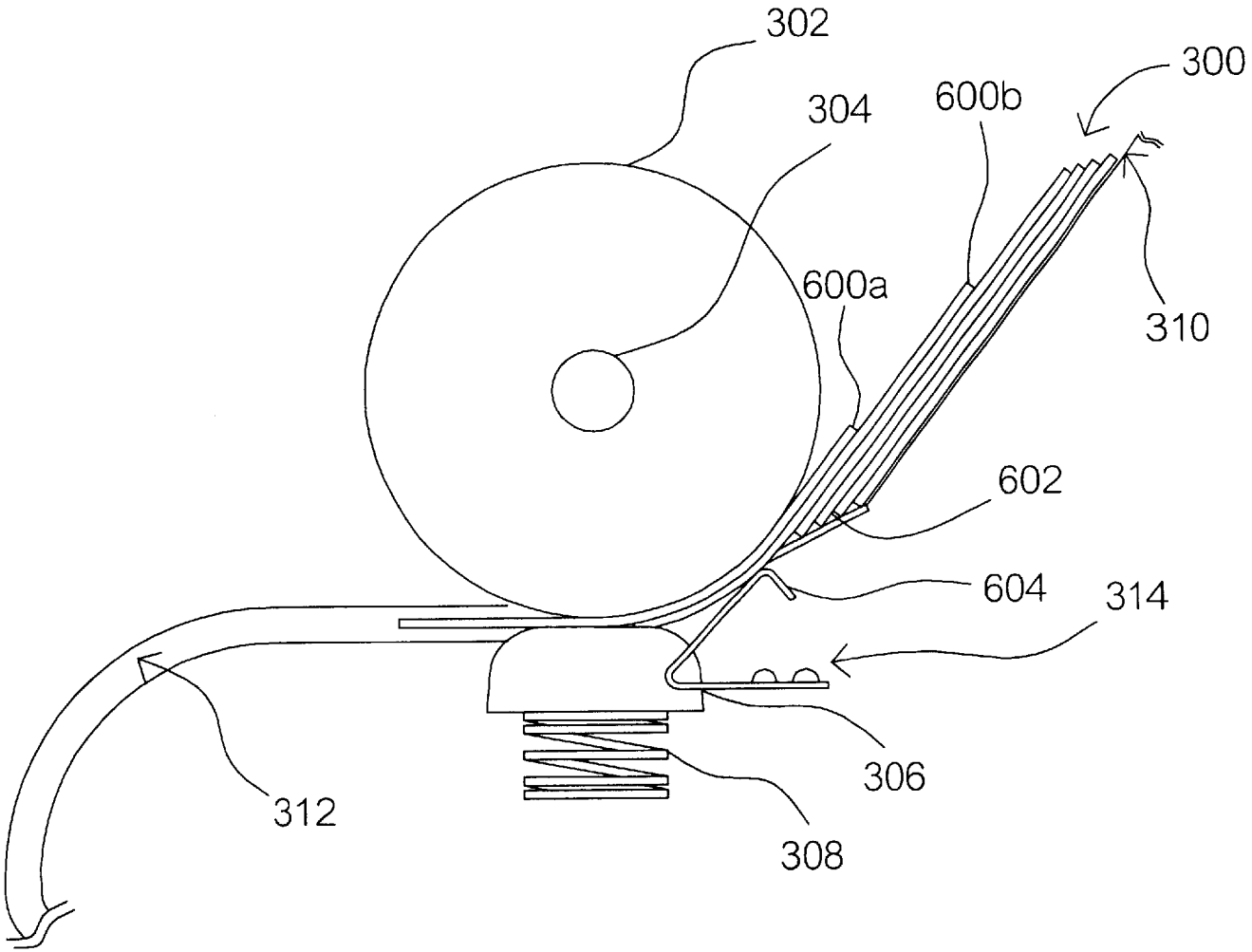
FIG. 6B shows the second phase of document feeding for the document separating mechanism in FIG. 3.

In the first phase of the document feeding for the document separating mechanism 40, the document guiding incline 602 makes the documents being pressed by the feeding roller 302 and arranged in order initially. In addition, the vertical plane 604 resists the leading edges of the second and the latter fed documents 300 directly or indirectly. If the documents are under double feeding condition in the first phase, the documents can be further sequentially arranged in the second phrase. Referring to FIG. 6B, the second phase of document feeding for the document separating mechanism in FIG. 3 is shown. When the second document 600*b* is inadvertently drawn with the first document 600*a* since the documents are too thin or fails to be resisted by the vertical plane 604, the first document 600*a* is first pressed in between the feeding roller 302 and the rubber friction pad 306 with the elasticity of the spring unit 308 below the rubber friction pad 306. The document separating mechanism 314 provides a force to make the documents being pressed by the feeding roller 302, the leading edge of the second document 600*b* comes into contact with the roller pad 306. The second document 600*b* is resisted since the coefficient of friction between the second document 600*b* and the roller pad 306 is greater than that of between the two documents 600*a* and 600*b*. After the first document 600*a* is delivered, the second document 600*b* is then pressed in between the feeding roller 302 and the rubber friction pad 306 and the second phase of the document feeding is accomplished.

The document separating mechanism for an automatic document feeder according to the preferred embodiment of the invention utilizes the document guiding incline to make the documents being pressed the feeding roller and arranged in order for preventing the multiple feeding or jam condition as result of the inadequate arrangement of documents. The two phases of document feeding and the elastic structure of the document separating mechanism enable the vertical plane of the document separating mechanism to resist the leading edges of the second and the latter fed documents directly or indirectly. It can improve the multiple feeding condition caused by the variation of the documents. Therefore, it only requires the document separating mechanism with simple structure.to solve the multiple feeding problem of the fax machine, scanner, or printer.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A document separating mechanism for an Automatic Document Feeder, wherein the Automatic Document Feeder has a feeding roller for carrying documents forward, the document separating mechanism comprising:

a main plane having a plurality of edges;

a vertical plane, perpendicular to the main plane and capable of resisting the leading edges of the documents directly or indirectly; and an arc surface between the vertical plane and the main plane, wherein the arc surface joins the vertical plane and the main plane;

wherein the document separating mechanism is an elastomer; and wherein the thickness of the document is substantially smaller than a half and greater than a quarter of the radius of curvature of the arc surface ($0.25R<T<0.5R$).

2. The document separating mechanism according to claim 1, wherein the document separating mechanism further comprises a first document guiding incline and a second document guiding incline which are linked to the main plane with the same slope respectively, said first and second document guiding inclines causing the documents to engage the feeding roller and arranging an initial order thereof.

3. The document separating mechanism according to claim 2, wherein the Automatic Document Feeder further comprises a rubber friction pad along with a spring unit below capable of making the documents being pressed by the feeding roller.

4. The document separating mechanism according to claim 3, wherein the Automatic Document Feeder is applied to a fax machine.

5. The document separating mechanism according to claim 3, wherein the Automatic Document Feeder is applied to a scanner.

6. The document separating mechanism according to claim 3, wherein the Automatic Document Feeder is applied to a printer.

7. A document separating mechanism for an Automatic Document Feeder, wherein the Automatic Document Feeder has a feeding roller for carrying documents forward, the document separating mechanism comprising:

a main plane;

a vertical plane, perpendicular to the main plane and capable of resisting the leading edges of the documents directly or indirectly; and an arc surface between the vertical plane and the main plane, wherein the arc surface joins the vertical plane and the main plane;

wherein the arc surface has a radius of curvature (R) that satisfies $0.25(R)<(T)<0.5(R)$, wherein T is a thickness of the document.

8. A document separating apparatus adapted for use with a feeding roller of an automatic document feeder, the feeding roller feeding documents in a downstream direction, comprising:

a main plane;

a vertical plane arranged perpendicular to the main plane for resisting leading edges of the documents, and being disposed upstream relative to the main plane; and an arc plane monolithically formed between the main plane and the vertical plane.

9. The document separating apparatus of claim 8, wherein the document separating apparatus is an elastomer.

10. The document separating apparatus of claim 8, further comprising a first guiding incline and a second guiding incline monolithically connected to the main plane, and each having a same slope, said first and second guiding inclines being adapted to arrange an initial order of the documents.

11. The document separating apparatus of claim 8, wherein a thickness of the documents is smaller than a half, and bigger than a quarter of a radius of curvature of the arc plane.

12. The document separating apparatus of claim 8, wherein the automatic document feeder further comprises a feed pad along with a spring unit, and wherein the spring is placed below the feed pad.

13. The document separating apparatus of claim 8, wherein the document separating apparatus is adapted for use in a fax machine.

14. The document separating apparatus of claim 8, wherein the document separating apparatus is adapted for use in a scanner.

15. The document separating apparatus of claim 8, wherein the document separating apparatus is adapted for use in a printer.

* * * * *